US007779604B2

(12) United States Patent
Kapelski

(10) Patent No.: US 7,779,604 B2
(45) Date of Patent: Aug. 24, 2010

(54) DEVICE FOR INSERTING TWIST LOCK CONTAINER SAFETY FITTINGS

(76) Inventor: Rainer Kapelski, Norderstrasse 46, 24401 Böel (DE)

( * ) Notice: Subject to any disclaimer, the term of this patent is extended or adjusted under 35 U.S.C. 154(b) by 32 days.

(21) Appl. No.: 12/224,365

(22) PCT Filed: Mar. 1, 2007

(86) PCT No.: PCT/DE2007/000380

§ 371 (c)(1),
(2), (4) Date: Oct. 28, 2008

(87) PCT Pub. No.: WO2007/098749

PCT Pub. Date: Sep. 7, 2007

(65) Prior Publication Data

US 2009/0199517 A1 Aug. 13, 2009

(30) Foreign Application Priority Data

Mar. 2, 2006 (DE) ..... 20 2006 003 435 U
Apr. 3, 2006 (DE) ..... 10 2006 015 807

(51) Int. Cl.
*B65B 57/00* (2006.01)
*B65B 25/02* (2006.01)

(52) U.S. Cl. ..... 53/77; 53/158; 53/544; 114/75; 414/140.3; 414/139.4

(58) Field of Classification Search ..... 53/540, 53/544, 158, 147, 531, 416, 77; 114/75; 414/140.3, 139.4
See application file for complete search history.

(56) References Cited

U.S. PATENT DOCUMENTS

| | | | | |
|---|---|---|---|---|
| 3,827,384 | A * | 8/1974 | Lunde et al. | 114/72 |
| 4,199,094 | A * | 4/1980 | Birkhofer et al. | 227/37 |
| 5,356,249 | A * | 10/1994 | Hove | 410/83 |
| 6,554,557 | B1 | 4/2003 | Takehara et al. | |
| 6,688,249 | B1 * | 2/2004 | Klein Breteler et al. | 114/75 |
| 7,556,472 | B2 * | 7/2009 | Arneson et al. | 414/808 |
| 2006/0115350 | A1 * | 6/2006 | Weis | 414/139.4 |
| 2007/0128005 | A1 * | 6/2007 | Di Rosa | 414/141.3 |
| 2008/0286074 | A1 * | 11/2008 | Chellappa et al. | 414/140.3 |

FOREIGN PATENT DOCUMENTS

| | | |
|---|---|---|
| WO | 2004/065264 | 8/2004 |
| WO | 2006/024071 | 3/2006 |
| WO | 2007/021246 | 2/2007 |

* cited by examiner

*Primary Examiner*—Christopher Harmon
(74) *Attorney, Agent, or Firm*—Diederiks & Whitelaw PLC

(57) ABSTRACT

A device for inserting and removing securing fittings for twist-lock containers includes a support plate for containers, which is provided with a pneumatically or hydraulically driven screwing mechanism with a slot gripper for each expected position of a securing fitting for the twist-lock container.

9 Claims, 4 Drawing Sheets

DEVICE FOR INSERTING TWIST LOCK CONTAINER SAFETY FITTINGS

CROSS-REFERENCE TO RELATED APPLICATIONS

This application represents a National Stage application of PCT/DE2007/000380 entitled "Device and Method for Inserting and Removing Securing Fittings for Twist-Lock Containers" filed Mar. 1, 2007.

BACKGROUND OF THE INVENTION

On loading and unloading container ships or other container-transporting means use is made of so-called twist locks, which are inserted in recesses at the corners of the containers for fixing the same to one another or to the stacking area.

There is clearly a need of rapidly fitting these twist locks, which do not form part of the containers, and then release them again from the container when not in use and to safely keep them in stock for the following use, so that they do not become dirty or lost. Thus, twist locks not correctly stored or placed in the operating area on the roadway used by large stackers constitute a hazard for the stacker tyres, because they can damage the same.

Hitherto part of this problem, namely the fitting using complicated devices such as are e.g. described in U.S. Pat. No. 6,688,249 B1 has been solved or, as is standard practice through the world in both small and large ports, by workers, who perform on the containers the corresponding manipulations such as removal, gripping and attaching when the containers are hanging at eye level on a crane.

The further problem exists that the workers can only move up to the container when it is stationary and before this the area at and around the container where lowering takes place is blocked. Moreover, hitherto the crane operator has had to estimate to what level he must lower the container so that it can be easily reached manually, whilst greatly reducing in stepwise manner the lowering speed.

SUMMARY OF THE INVENTION

The invention solves the problem with a device that not only creates a clearly defined platform on which by corresponding guides a container comes to rest at a clearly defined location and where a complete blocking is possible (i.e. unlike as hitherto an approach is avoided).

Instead, if desired, cranes or people can move freely around the platform. In particular, access is no longer necessary under suspended loads on a freely hanging container and instead, if needed at all, access takes place to a set-down plate on which no container is resting (i.e. the workers are also freely visible).

Locking and unlocking takes place automatically. A proposal is made either for a pneumatic or a hydraulic screwing device operating with a piston or in particular a compressed air-operated screwing device similar to the wheel nut tools used in motor vehicle workshops.

For removing a twist lock only a roughly 90° rotation is needed. This takes place in that the twist locks come to rest in, in each case, a reception slot provided in the device (facing the anticipated locations of the container corners), which bring them into the rotation position where they can be detached from the container counter to the spring tension provided in the twist lock.

After rotating a twist lock end into a clearly defined position the container can be raised and the twist locks are left in the receptacle.

Through magazines provided at the four corners on reinserting the usually four twist locks at the container corners, insertion can take place equally rapidly and in automated manner.

However, retrofitting of such a platform is not readily possible for use in ports where heavy industrial trucks move freely around and cranes run on rails along the quay. It is not possible for power supply or compressed air lines to be laid readily on the harbour surface, because they would be exposed to considerable loading by the heavy cranes or would be prejudicial to free movement and it is also not possible for a motor to generate energy, because then "refuelling" would be needed at rectangular intervals and unacceptable maintenance costs would be involved. In particular the supply of compressed air is very complicated.

Therefore a preferred development of the invention is able to produce the compressed air required for operating the receptacles in that below the receptacle or set-down plate gas storage devices or reservoirs are provided, which are compressed by the containers placed thereon and by corresponding electronic or hydraulic valve control supply the then compressed gas to a compressed gas storage device or reservoir.

Optionally for supplying the electronic control means a battery can be provided, which is charged by the pressurized gas motor or, if necessary, in some other way.

It is particularly advantageous that prior to the final setting down the container no longer has to be stopped at working level in order to e.g. manually remove twist locks. In addition, the crane can bring the container rapidly onto the device, referred to as a lashing platform, for inserting twist lock container safety fittings, because as a result of the pressurized gas spring-like "padded" behaviour of the lashing platform no container damage need be feared.

It is also possible for several already interconnected containers to be placed in superimposed manner on the device and then a crane can e.g. transport away three empty containers at once and which are interconnected by twist locks. A crane will precisely place on a lower container a top container already equipped with twist locks assisted by lashing platform guides and the semiautomatic twist locks ensure the secure union.

As a result of the load distribution of the lower frame the ground under the frame is less stressed in the gantry area. There can no longer be a hard impact of the container on e.g. a harbour surface plaster, where the problem might arise of sensitive goods within the container and also the gantry area asphalt being damaged.

Advantageously the platform is available in a 40" container-corresponding form and can either receive a 20" container, 2×20" container, a 40" container or, with corresponding overhangs, a 45" container. Alternatively the set-down plate can be designed in pneumatically or hydraulically telescopable manner for 45".

BRIEF DESCRIPTION OF THE DRAWINGS

Further features and advantages of the invention can be gathered from the following description of a preferred embodiment relative to the attached drawings, wherein show.

DETAILED DESCRIPTION OF THE INVENTION

Figure 1:
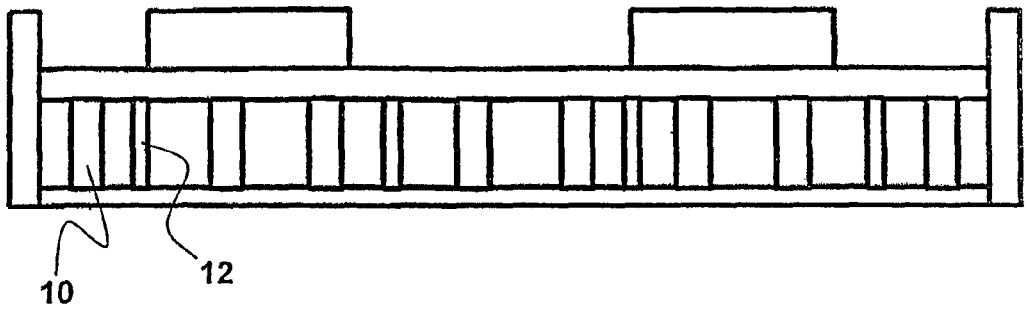
FIG. 1A side view of the inventive device.
Figure 4:
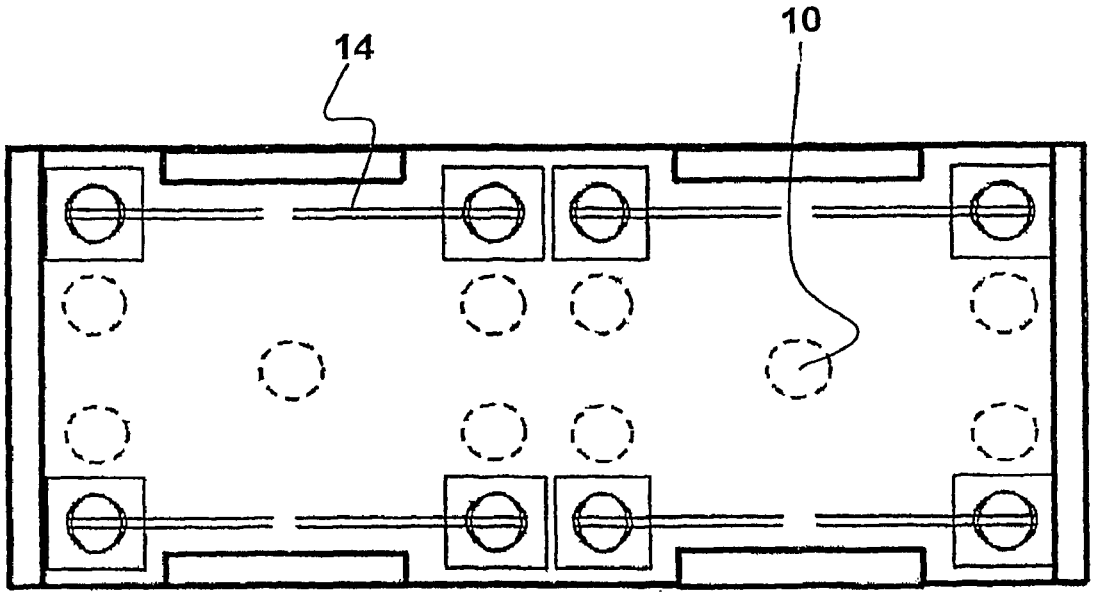
FIG. 4 A plan view of the device of FIG. 1 with eight magazine-equipped screwing devices and in broken line form air bellows.

FIGS. 1 and 4 show the individual shock absorbers, air bellows 10 or compressors whereof, other than as shown, large numbers can be present under the platform. Energy is acquired by them during the gentle lowering process for the containers and this is kept in stock in a pressurized gas storage device.

FIG. 1 shows how air bellows 10 and hydraulic shock absorbers 12 can be provided in combination.

Figure 2:
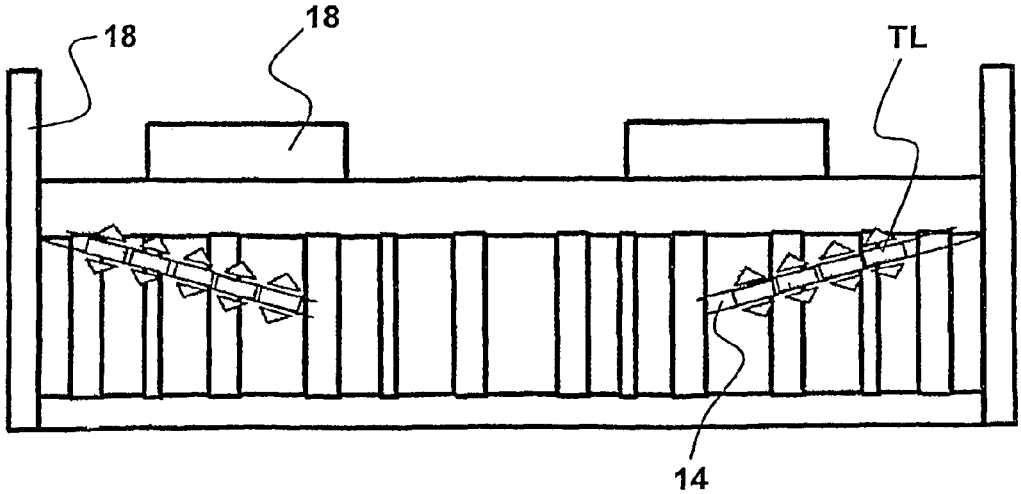
FIG. 2 The device of FIG. 1 in the unloaded state with diagrammatically intimated magazines for twist lock fittings, e.g. in each corner.
Figure 3:
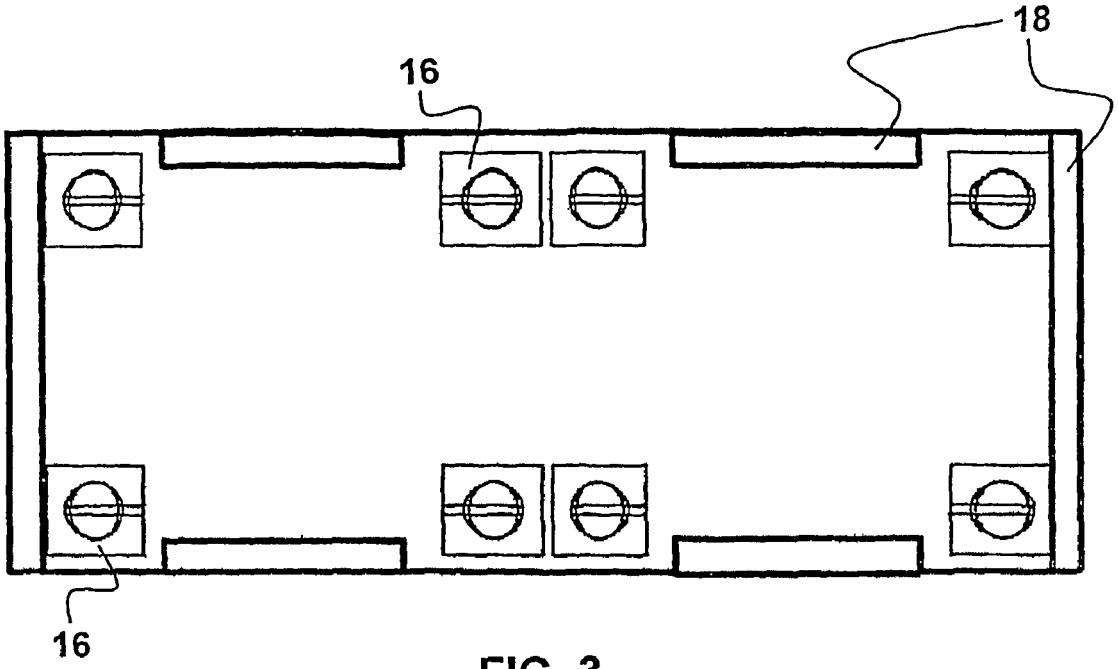
FIG. 3 A plan view of the device of FIG. 1 with eight screwing devices.

By means of corresponding removal devices 16 (FIGS. 3 and 4) provided in the corners and/or sides of the platform adjacent to the storage locations in the container and which grip and reverse compressed air-operated twist locks TL, the latter can be removed from the container in a single operation and then the container can be transported on without the twist locks TL. The remaining twist locks TL in the stacking fitting holders, either in a simple variant removal by personnel (time is available for this because the crane is raising another container elsewhere) or optionally by a corresponding removal device for conveying into a magazine 14 (cf. FIG. 2).

In hitherto conventional cycles of 30 containers per hour one person can manually place the twist locks TL in a readily available magazine and optionally check the twist locks TL optically for their condition. As opposed to the manual removal of twist locks TL from a container the major advantage is obtained that the actually container need no longer be stopped for a long period during its transportation and in particular does not have to be slowly and visually brought by a crane operator into a position suspended e.g. 1.50 m above the ground and instead it is possible to rapidly move up to a predetermined position, optionally facilitated by mechanical guides 18 and following brief delay resulting from the simultaneous release of all four twist locks TL, the container can be transported on again.

Obviously in a loading process the device can also be differently used, namely the corresponding twist locks TL can already be present in the stacking fitting holders 16 and on setting down the container automatically lock in the fixing holes (which is the functionality of the twist locks TL, namely that although positioned at right angles to the fixing hole, they turn during the insertion process and then automatically lock in spring-preloaded manner in a locking position). Alternatively twist locks TL can lock in controlled manner in a container.

Also in this process kinetic energy is again used for hydraulic or pneumatic introduction by means of compressors as working energy into storage means. It is obviously also possible to operate with external energy and a computer control can be provided in order to manage the storage and removal of the twist locks TL, i.e. to optionally demand from a magazine 14 more twist locks TL or to convey excess twist locks TL to such a magazine 14.

Figure 5:
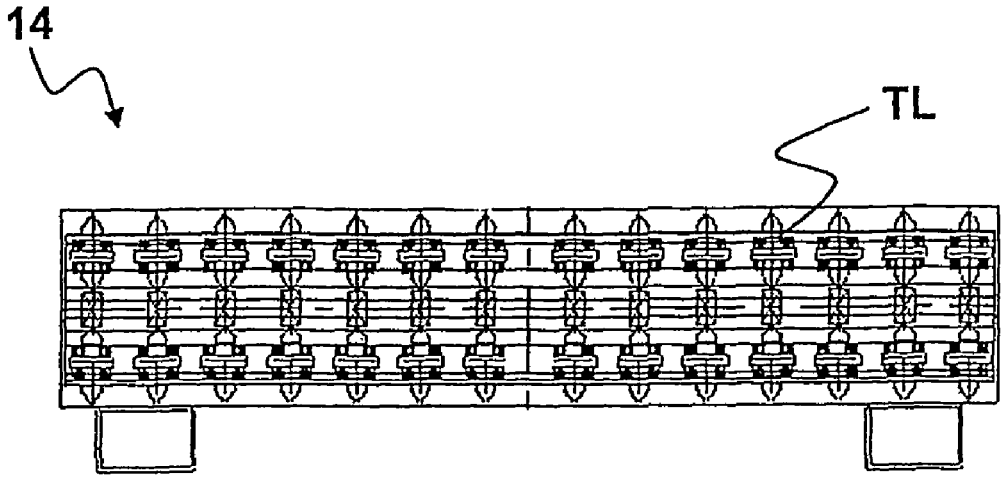
FIG. 5 A diagrammatic front view of a specially constructed magazine for the inventive device.
Figure 6:
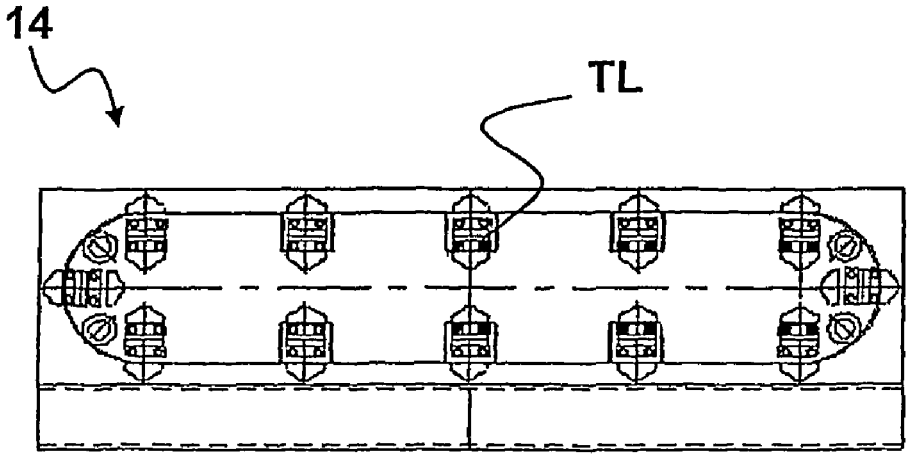
FIG. 6 A diagrammatic side view of the magazine of FIG. 5.

A special development of such a magazine is illustrated in a diagrammatic front view in FIG. 5 and a diagrammatic side view in FIG. 6. For providing to containers, in the illustrated example the twist locks TL are lined up on elongated, e.g. rod-like elements, which can be moved in the manner of a circulating conveyor belt. As a result of this construction it is possible to keep available a large number of twist locks TL. The elements receiving the twist locks TL is so further rotated when an element has given up all the twist locks TL stored on it to the removal device/screwing device 16, to make it possible for a further element to deliver the twist locks TL stored thereon to the screwing device 16.

Operation with the inventive device is preferably such that the working sequence is so set up that if a magazine 14 has been completely emptied of twist locks TL, subsequently only containers are placed on the device which have been freed from twist locks TL until the magazine 14 has been refilled with twist locks TL. This is followed by an operation during which containers are to be reequipped with twist locks TL.

Alternatively the device can also be constructed in such a way that the magazines are set up in replaceable manner and e.g. by access from the side of the device an empty magazine 14 can be replaced by a filled magazine 14 or vice versa. Preferably such a replaceable magazine 14 has e.g. pockets for receiving forklift forks.

Figure 7:
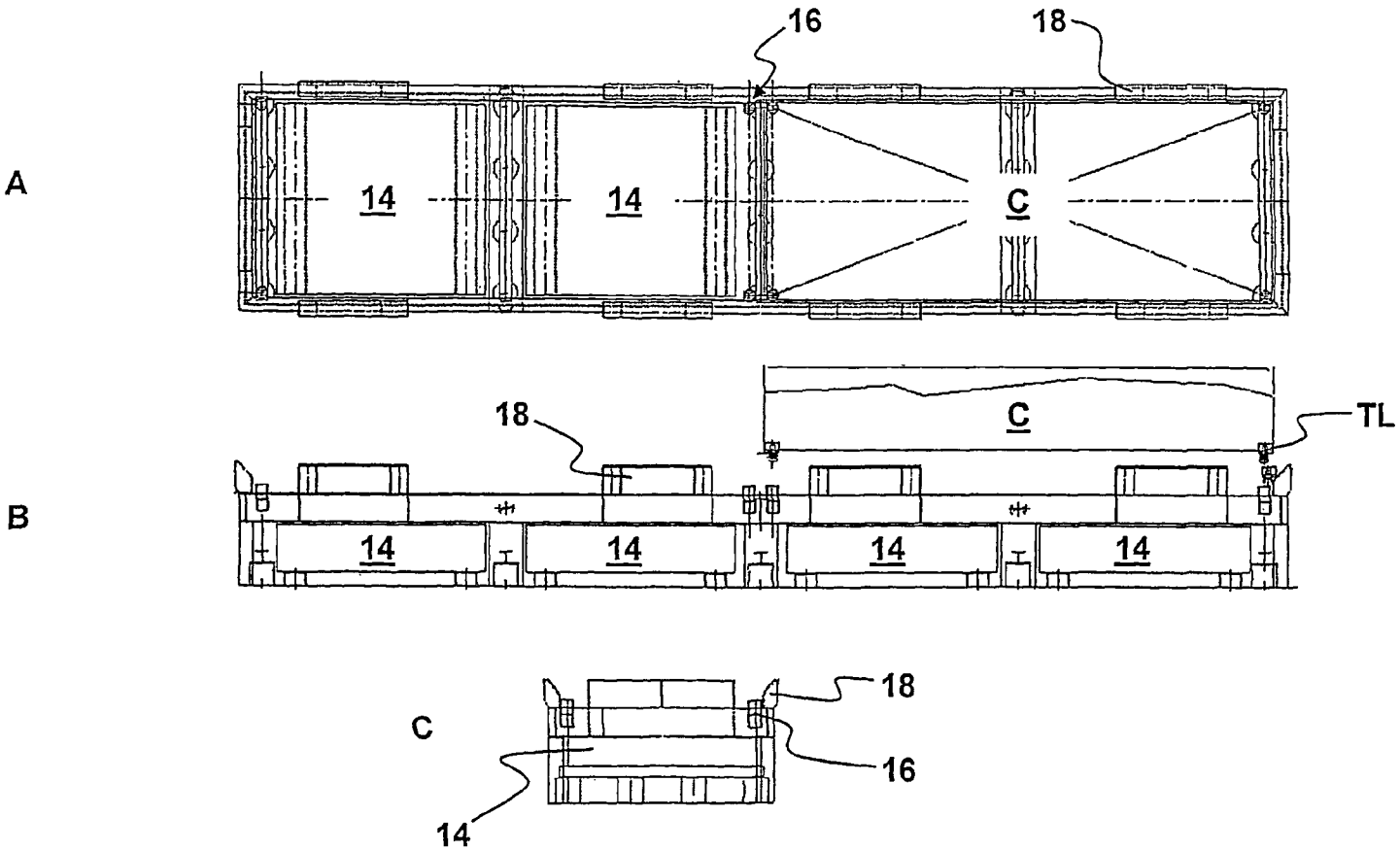
FIG. 7A-C A particularly preferred embodiment of the invention in a diagrammatic plan view (A), in a diagrammatic side view (B) and in a diagrammatic front view (C).

It is obviously also possible to juxtapose two lashing platforms in order e.g. with a tandem spreader to serve a gantry crane simultaneously gripping and transporting two containers, or a twin tandem with four containers. Such an implementation of the inventive device for a tandem spreader is shown in a diagrammatic plan view (FIG. 7A), a diagrammatic side view (FIG. 7B) and a diagrammatic front view (FIG. 7C. To illustrate the spatial conditions, in addition to the device according to the invention is shown a container C equipped with twist lock container safety fittings TL.

Each stacking fitting holder 16 comprises a rotary piston and a bushing, which by means of hydraulics or pneumatics with a drive and an exhaust bring the twist locks TL into a laterally fitted magazine 14 with a substantially vertical or horizontal orientation. It is also possible to have a worm-like, space-saving magazine guide.

It is finally pointed out that during transshipment wave movements e.g. caused by tides, high winds or shipping can cause ship movements making necessary a slight adaptation of the relative horizontal position of the container bridge with respect to the lashing platform. This horizontal movement of the entire lashing platform or at least the platform supporting frame receiving the container C can also be made possible by the working energy stored in the compressors and can be automatically or manually controlled.

Thus, according to the invention an automatically operated lashing platform can be made available which, in a preferred variant, obtains the energy necessary for releasing and fixing twist locks TL with respect to a container C or for horizontal platform positioning from the energy released on placing a container on the air bellows 10 or hydraulic shock absorbers 12 of the platform. Such a device increases the flexibility of use of lashing platforms and simultaneously increases productivity during transshipment of containers.

The invention claimed is:

1. A device for inserting and removing twist lock container safety fittings comprising a set-down plate for containers, which has for each anticipated location of a twist lock container safety fitting a fluid operated screwing device with a slotted gripper, a reception plate and wherein, below the reception plate are provided gas storage devices, which can be supplied through gravity of the set-down plate and the container resting thereon, an electronic valve control being connected for the further passage of gas compressed in the gas storage devices via pipelines to a pressurized gas storage device and further pipelines connecting the same to the screwing devices.

2. The device according to claim 1, further comprising magazines for twist lock container safety fittings provided for each screwing device.

3. The device according to claim 2, wherein the magazines are constructed as runways formed by sloping rods in which the twist lock container safety fittings are mounted in vertically sliding manner along the rods.

4. The device according to claim 1 further comprising vertical corner guides projecting over a height of a container and, upon sliding at vertical corner guides during lowering of the container into the device, storage locations of the twist locks in the container face the slotted grippers.

5. The device according to claim 1 wherein each screwing device is hydraulically operated.

6. A method for removing twist lock container safety fittings from a container comprising:

depositing a container on a spring-loaded, lowerable set-down plate for containers in an upper position and which for each twist lock container safety device has a compressed air-operated screwing device with a slotted gripper and which is equipped with compressed air storage devices, which are supplied based on gravity acting on the set-down plate and the container resting thereon such that, on lowering the plate, compressed air is delivered via lines to the compressed air screwing devices, at the end of the lowering process the screwing devices have rotated the twist lock container safety fittings into a position no longer suspended on the container, raising the container and removing the twist lock container safety fittings from the screwing devices.

7. A method for equipping a container with twist lock container safety fittings comprising:

mounting the twist lock container safety fittings on screwing devices, placing a container on a spring-preloaded, lowerable set-down plate for containers located in an upper position and which at each anticipated location of a twist lock container safety fitting has a fluid-operated screwing device with a twist lock container safety fitting on a slotted gripper and which is equipped with compressed air storage devices which on lowering the plate deliver compressed air, due to gravity acting on the set-down plate and the container resting thereon, via lines to the compressed air screwing devices, at the end of the lowering process the screwing devices have rotated the twist lock container safety fittings into a position suspended on the container, raising the container with the twist lock container safety fittings from the screwing devices.

8. The device according to claim 1 wherein the screwing device is compressed-air operated.

9. The device according to claim 1 wherein the screwing device is hydraulically operated.

* * * * *